United States Patent [19]
Lichtblau

[11] 4,251,808
[45] Feb. 17, 1981

[54] SHIELDED BALANCED LOOP ANTENNAS FOR ELECTRONIC SECURITY SYSTEMS

[76] Inventor: George J. Lichtblau, 13 Tannery Hill Rd., Ridgefield, Conn. 06877

[21] Appl. No.: 94,429

[22] Filed: Nov. 15, 1979

[51] Int. Cl.³ ..... G08B 13/24
[52] U.S. Cl. ..... 340/572; 343/842
[58] Field of Search ..... 340/572; 343/842

[56] References Cited

U.S. PATENT DOCUMENTS

| | | | |
|---|---|---|---|
| 3,810,147 | 5/1974 | Lichtblau | 340/572 |
| 3,863,244 | 1/1975 | Lichtblau | 340/572 |
| 3,967,161 | 6/1976 | Lichtblau | 340/572 |

FOREIGN PATENT DOCUMENTS

| | | | |
|---|---|---|---|
| 419783 | 11/1934 | United Kingdom | 343/842 |

*Primary Examiner*—Glen R. Swann, III
*Attorney, Agent, or Firm*—Weingarten, Maxham & Schurgin

[57] ABSTRACT

For use in an electronic security system for detection of a resonant tag, an antenna system has a transmitting antenna and a receiving antenna at least one of which includes two or more twisted loops lying in a common plane with each loop being twisted 180° to be in phase opposition, and a conductive shield enclosing each twisted loop antenna. The conductive shield has a grounded shorted turn portion enclosing the periphery of the antenna, and a shield portion enclosing the crossed conductors of each pair of twisted loops, this latter shield portion being insulated from the shorted turn portion to prevent current flow in the crossover shield portion.

6 Claims, 8 Drawing Figures

SHIELDED BALANCED LOOP ANTENNAS FOR ELECTRONIC SECURITY SYSTEMS

FIELD OF THE INVENTION

This invention relates to electronic security systems and more particularly to shielded balanced loop antennas for use with such systems.

BACKGROUND OF THE INVENTION

Electronic security systems are known for the detection of the unauthorized removal of items containing a resonant tag circuit. A preferred system is described in U.S. Pat. Nos. 3,810,147, 3,863,244 and 3,967,161. Such systems employ a transmitter providing an electromagnetic field in a zone or region under surveillance, and through which items must pass for detection, and a receiver operative to detect the field disturbance caused by the presence of a resonant tag in the surveillance zone and to provide an output alarm indication of tag presence. In these electronic security systems described in the aforesaid patents, two identical planar loop antennas are usually employed, one for transmitting and one for receiving. The transmitting loop antenna generates an electromagnetic field which is repetitively swept through a predetermined frequency band which includes the resonant frequency of the tag circuit. The receiving antenna is operative to sample the field generated by the transmitter and to detect the change in this field caused by the resonant circuit.

An antenna system is described in copending applications Ser. No. 878,753 filed Feb. 17, 1978, and Ser. No. 92,325 filed Nov. 8, 1979 (GL-12A), of the same inventor as herein, which provide improved performance in the associated electronic security system in reducing high intensity fields at distances outside of the interrogation region and in reducing the sensitivity to interferring signals originating outside of the interrogation region. The antenna system of copending application Ser. No. 878,753 comprises a pair of substantially identical planar loop antennas respectively connected to the transmitter and receiver of the security system and providing an electromagnetic field of high intensity in the interrogation region of the system, while preventing high intensity fields at distances outside of the interrogation region which are large in comparison to the antenna dimensions. The antenna system also discriminates against interferring signals originating outside of the interrogation region at distances large compared with the antenna dimensions.

Each planar antenna includes two or more loops lying in a common plane, with each loop being twisted 180° with respect to each adjacent loop to be in phase opposition. The transmitting antenna and receiving antenna are symmetrical, that is, identical or nearly so with respect to the number and size of the two or more loops, and are cooperative in that twisted loops of the receiving antenna reverse or decode the adjacent phase relationship of the twisted loops of the transmitting antenna. For each antenna, the total loop area of one phase is equal to the total loop area of opposite phase in order to achieve optimum performance.

The antenna system of copending application Ser. No. 92,325 is similar, but the two cooperating planar antennas are not symmetrical to each other. The transmitting antenna can be a single loop planar antenna while the receiving antenna can include two or more loops lying in a common plane with each loop being twisted 180° with respect to each adjacent loop. Alternatively, the transmitting antenna can have two planar loops and the receiving antenna three planar loops, the loops of each antenna lying in a common plane with each loop being twisted 180° with respect to each adjacent loop to be in phase opposition.

The antenna system of both copending applications are effective to reject radio frequency interference generated by magnetic fields at distances from the antenna large compared to the antenna dimensions. However, such antennas are still susceptible to electrical noise which is coupled capacitively to the antenna. Such capacitive noise coupling is illustrated in FIG. 8 whereas the noise is represented by a source 90 which is capacitively coupled to the antenna. The differential amplifier 92 represents a typical front end circuit of the system receiver.

Referring to FIG. 8, magnetic fields generated at a distance large compared to the dimensions of the antenna couple equally to loop #1 and loop #2. Since these loops are twisted 180° with respect to each other and are equal in area, the net voltage of the two loops cancel each other. Noise capacitively coupled to one side of the antenna, however, is not cancelled out. As illustrated, the noise source 90 is capacitively coupled to the lower loop (#2), and strongly coupled to only one side of this loop. The signal path "A" from the noise source to a differential amplifier 92 is much longer than the path "B". Therefore, the impedance of path "A" is much greater than path "B". As a result, the noise signal capacitively coupled to the antenna produces a real signal at the positive input of the differential amplifier.

It is the object of the present invention to provide an antenna system for use in a resonant tag detection system which is not sensitive to capacitively coupled noise, as well as offering the advantages of electromagnetic noise rejection and other benefits offered by the antenna system of the aforesaid copending applications.

SUMMARY OF THE INVENTION

In accordance with the present invention, an antenna system is provided for use in an electronic security system in which each multiple loop planar antenna is substantially enclosed within a conductive shield to substantially eliminate capacitive coupling of noise to the antenna. Each multiple loop antenna is enclosed within a metal or other conductive shield which is grounded to provide a shorted turn around the periphery of the multiple loop antenna. The crosswires of the twisted loops are enclosed within a shield portion which is electrically separated from the shorted turn so that no electrical current path is provided through the crossover shield portion. The novel antenna is totally shielded from capacitive coupling to external sources of noise or spurious signals.

If the antenna is perfectly balanced, no currents flow in the shorted turn of the shield since no net voltages are induced into the shield by the antenna magnetic field. If there is a small unbalance in the multiple loop antenna such that a voltage is induced into the shorted turn of the shield, the current flowing in the shield loop tends to cancel out the magnetic unbalance, and thus the shorted shield loop automatically corrects for small unbalances in the multiple loop antenna and reduces the magnetic fields external to the loop at distances outside of the interrogation region.

DESCRIPTION OF THE DRAWINGS

The invention will be more fully understood from the following detailed description taken in conjunction with the accompanying drawings in which.

DETAILED DESCRIPTION OF THE INVENTION

Figure 1:
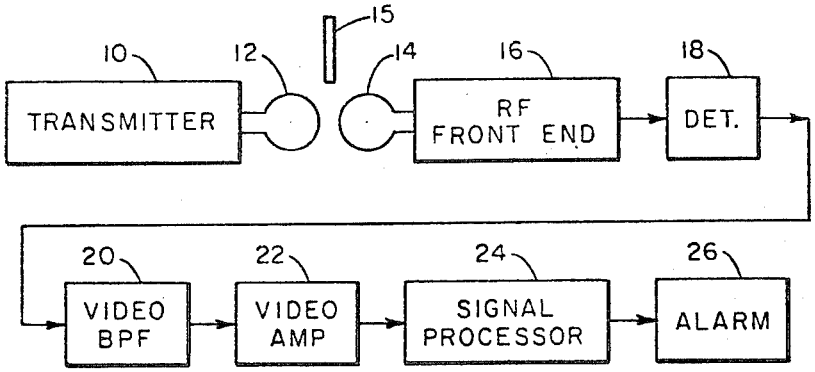
FIG. 1 is a block diagram of a electronic security system in which the invention is employed.

An electronic security system is shown in FIG. 1 and includes a transmitter 10 coupled to an antenna 12 operative to provide an electromagnetic field within a predetermined area to be controlled and which is repetitively swept over an intended frequency range. A receiving antenna 14 at the controlled area receives energy electromagnetically coupled from antenna 12 and is coupled to an RF front end 16 which includes an RF bandpass filter and RF amplifier. The output of the front end 16 is applied to a detector 18, and a video bandpass filter 20 the output of which is effective to pass only an intended frequency band and to remove carrier frequency components and high frequency noise. The output of filter 20 is applied to a video amplifier 22 and thence to signal processor 24, the output signal of which is applied to an alarm 26 or other output utilization apparatus to denote detection of a resonant tag 15 in the controlled area. The system illustrated in FIG. 1, is the subject of the above-identified U.S. Pat. Nos. 3,810,147, 3,863,244 and 3,967,161, and is operative to detect tag presence in a controlled area and to provide an alarm indication thereof. The signal processor 24 includes noise rejection circuitry operative to discriminate between actual tag signals and spurious signals which could be falsely detected as a tag and therefore cause a false alarm, as described in the aforesaid patents.

Figure 2:
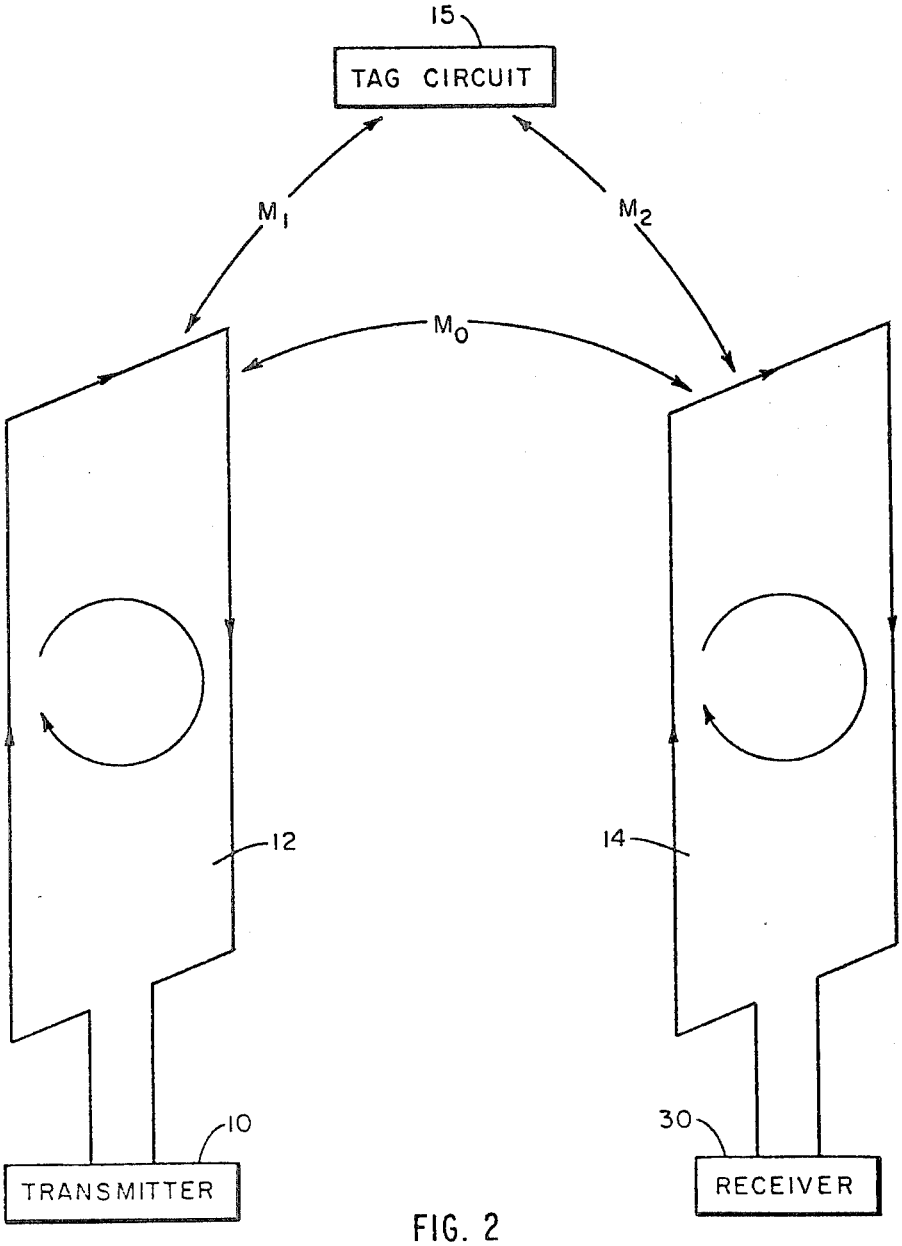
FIG. 2 PRIOR ART
FIG. 2 is a schematic diagram of prior art loop antennas employed in electronic security systems.

The antennas of the single loop type employed in the prior art are schematically illustrated in FIG. 2. The transmitting antenna 12 and receiving antenna 14 are each composed of a single rectangular loop of the same size and shape. The transmitting antenna 12 is connected to and energized by a transmitter 10, while the receiving antenna 14 is connected to a receiver 30 such as that depicted in FIG. 1. The respective antennas 12 and 14 are arranged on opposite sides of a passage or aisle and between which is the interrogation region through which items pass for detection of unauthorized removal. There is a relatively strong mutual magnetic coupling $M_o$ between the antennas 12 and 14. In the presence of a resonant tag circuit 15 in the interrogation region of the system, there is a magnetic coupling $M_1$ from the transmitting antenna 12 to the tag circuit 15, and a magnetic coupling $M_2$ from the tag circuit 15 to the receiving antenna 14. As the transmitted field is swept through the resonant frequency of tag circuit 15, the current induced in the resonant circuit varies as a function of frequency, in well-known manner. The current in the resonant tag 15 is magnetically coupled to the receiver antenna 14 and produces the tag signal. The resonant tag signal is then detected and processed in receiver 30 to discriminate a true tag signal from noise and to provide an output signal to an alarm or other output utilization apparatus denoting detection of a resonant tag in the controlled area.

Figure 3:
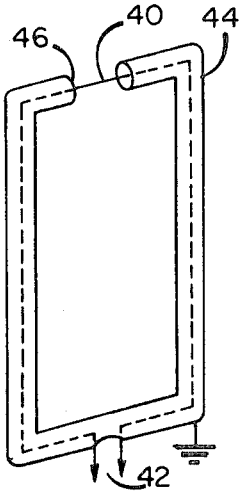
FIG. 3 PRIOR ART
FIG. 3 is a schematic representation of a prior art shielded loop antenna.

A shielded single loop antenna of known construction is shown in FIG. 3 and includes an antenna conductor 40 formed into a rectangular loop and having a pair of leads 42 for connection to a transmitter or receiver of associated apparatus. An electrical shield 44 is provided in the form of a tube or pipe of metal or other conductive material which is grounded and which surrounds the conductor 40, except for a portion 46 which is broken or separated to eliminate a closed conductive path in the shield. The shield prevents electrostatic fields from coupling to the antenna, but still permits magnetic fields to be coupled. The shield must be split to prevent current from circulating in the shield itself. If current were permitted to circulate in the shield, this current would tend to repel any magnetic field trying to pass through the shorted turn, and thus through the loop antenna itself. Thus, a shorted turn would radically reduce the sensitivity of the loop antenna and completely alter its receiving characteristics.

Figure 4:
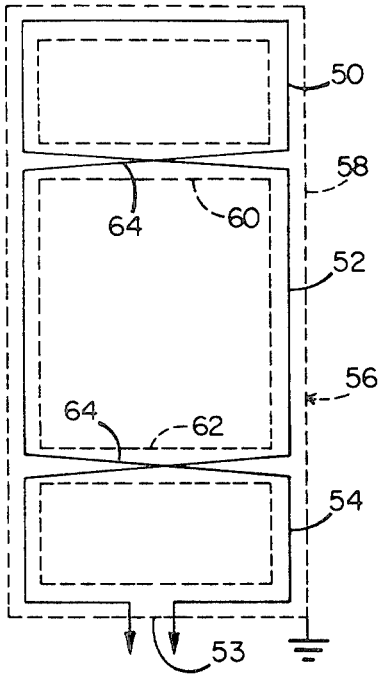
FIG. 4 is a schematic representation of one embodiment of the novel antenna system.
Figure 5:
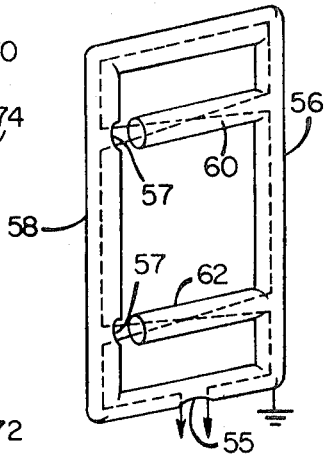
FIG. 5 is a pictorial diagram of the shield structure of the embodiment of FIG. 4.

The novel antenna system is shown in a preferred embodiment in FIG. 4 and 5 and having three generally rectangular twisted loops 50, 52 and 54 lying in a common plane. The outer loops 50 and 54 are each one-half the area of the center loop 52. Each loop is twisted to be 180° out of phase with respect to each adjacent loop. The outer loops 50 and 54 are in phase with each other and 180° out of phase with the center loop 52. The leads 53 of the twisted planar loop antenna are for coupling of the antenna to the transmitter or receiver of the electronic security system.

A metal or other conductive shield 56 is provided to enclose the antenna loops. The shield includes a surrounding portion 58, such as a metal tube, enclosing the periphery of the antenna and providing a shorted turn which is grounded. The crossover portions 60 and 62 of the shield which enclose the crossed conductors 64 of the adjacent twisted loops are electrically separated or insulated from the shorted turn portion 58 of the shield at one or both ends of the cross-over shield portions. In the illustrated embodiments, portions 60 and 62 are connected at one end to portion 58 and are physically separated from portion 58 at their opposite ends. If the antenna is perfectly balanced, that is, if the area of the center loop is exactly equal to the total area of the outer loops, no net voltage will be induced into the shield shorted turn 58, and no current will flow in the shorted turn of the shield. If there is an unbalance in the antenna, a voltage will be induced into the shield shorted turn 58, and the current flowing in this turn will tend to cancel out the magnetic unbalance and will automatically correct for small unbalances in the antenna.

The antenna is supported in the conductive shield structure by any convenient means to maintain the antenna out of electrical contact with the shield. Suitable insulating spacers can be employed, for example, to support the antenna conductor away from the surrounding shield. An opening 55 is provided in the shorted turn of the shield through which the antenna leads extend for connection to the associated transmitter or receiver of the security system. Openings 57 are also provided in the shorted turn portion to permit passage of the crossed conductors 64.

Figure 6:
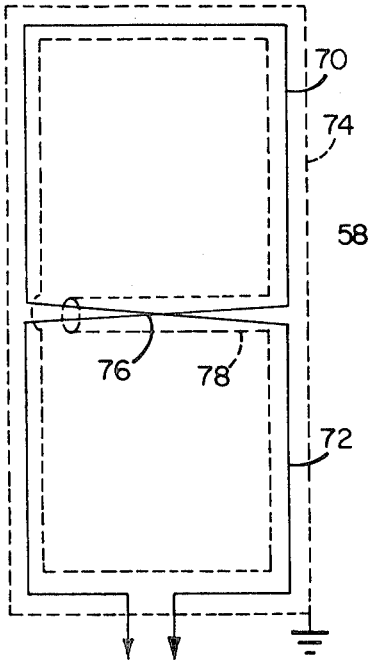
FIG. 6 is a schematic representation of an alternative embodiment of the novel antenna system.
Figure 7:
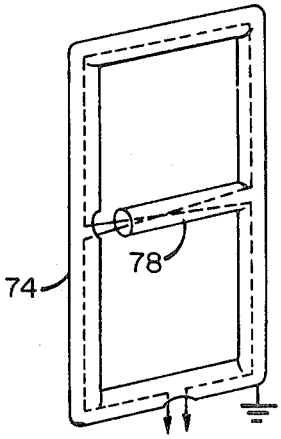
FIG. 7 is a pictorial diagram of the shield structure of the FIG. 6 embodiment.
Figure 8:
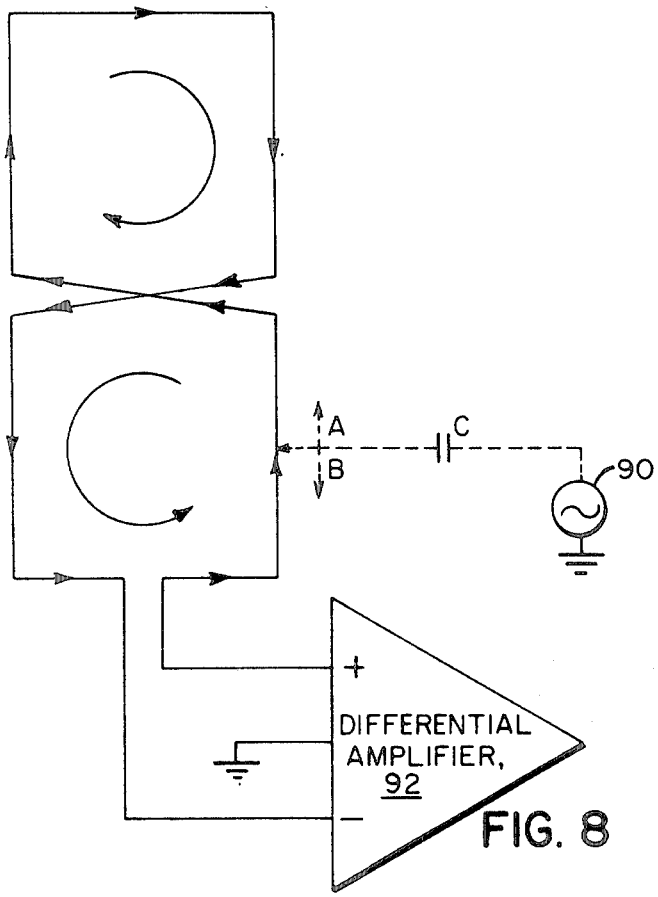
FIG. 8 is a schematic diagram useful in illustrating the capacitive coupling of noise to an antenna.

An alternative embodiment is shown in FIG. 6 and 7 and having two generally rectangular twisted loops 70 and 72 lying in a common plane. The loops are of the same area, and each is twisted to be 180° out of phase relative to the adjacent loop. The conductive shield includes a surrounding peripheral portion 74 which encloses the periphery of the antenna and which provides a grounded shorted turn. The crossed conductors 76 are enclosed within a shield portion 78. The shield portion 78 is electrically insulated or separated from the shorted turn portion 74 to prevent current flow in this cross-over shield portion.

The invention is not to be limited by what has been particularly shown and described except as indicated in the appended claims.

What is claimed is:

1. For use in an electronic security system having:

transmitter means for providing an electromagnetic field in a predetermined area at a frequency repetitively swept through a predetermined range of frequencies; a resonant tag circuit having at least one resonant frequency within said predetermined range of frequencies; receiver means for detecting the presence of said tag in said electromagnetic field and providing an alarm indication thereof, an antenna system comprising:

a transmitting antenna coupled to the security system transmitter and a receiving antenna coupled to the security system receiver, said antennas being disposed in spaced parallel relationship and between which said resonant tag must pass for detection;

at least one of said antennas having at least two twisted loops lying in a common plane, each loop being twisted 180° to be in phase opposition with each adjacent loop; and a conductive shield enclosing each twisted loop antenna and including a shorted turn portion enclosing the periphery of the antenna and being grounded to provide a grounded shorted turn, and a crossover shield portion enclosing the crossed conductors of each pair of twisted loops, each cross-over shield portion being insulated from the shorted turn portion to prevent current flow in the crossover shield portion.

2. For use in an electronic security system having:

transmitter means for providing an electromagnetic field in a predetermined area at a frequency repetitively swept through a predetermined range of frequencies; a resonant tag circuit having at least one resonant frequency within said predetermined range of frequencies; receiver means for detecting the presence of said tag in said electromagnetic field and providing an alarm indication thereof, an antenna system comprising:

a transmitting antenna adapted for coupling to said transmitter and having at least one loop lying in a plane;

a receiving antenna adapted for coupling to said receiver and having at least two twisted loops lying in a common plane, each loop being twisted 180° and in phase opposition with each adjacent loop;

said antennas having a mutual magnetic coupling therebetween and said receiving antenna having an effective total loop area of one phase equal to the effective total loop area of opposite phase;

said transmitting antenna and said receiving antenna being disposed in spaced substantially parallel relationship on respective opposite sides of a passage through which said resonant tag must pass for detection; and a conductive shield enclosing each twisted loop antenna and including a shorted turn portion enclosing the periphery of the antenna and providing a grounded shorted turn, and a crossover shield portion enclosing the crossed conductors of each pair of twisted loops, each crossover shield portion being insulated from the shorted turn portion to prevent current flow in the crossover shield portion.

3. The antenna system of claim 2 wherein the grounded shorted turn portion of the conductive shield includes a conductive tubular structure enclosing the peripheral portions of the antenna, and wherein the crossover portion of the shield includes a conductive tube enclosing the crossed conductors of each pair of twisted loops and electrically separated at at least one end from the tubular structure.

4. The antenna system of claim 3 wherein said tubular structure has an opening through which the lead wires of the associated antenna extend for coupling to an associated transmitter or receiver.

5. The antenna system of claim 2 wherein said transmitting antenna has at least two twisted loops lying in a common plane, each loop being twisted 180° and in phase opposition with each adjacent loop.

6. The antenna system of claim 5 wherein the grounded shorted turn portion of the conductive shield includes:

a conductive tubular structure enclosing the peripheral portions of the antenna, and respective openings in said tubular structure through which the lead wires of the antenna extend for coupling to an associated transmitter or receiver, and through which the crossed conductors of each pair of twisted loops extend.

* * * * *

UNITED STATES PATENT AND TRADEMARK OFFICE

CERTIFICATE OF CORRECTION

PATENT NO. : 4,251,808

DATED : February 17, 1981

INVENTOR(S) : George J. Lichtblau

It is certified that error appears in the above-identified patent and that said Letters Patent are hereby corrected as shown below:

Column 3, line 34, "video" should read --view--.

Signed and Sealed this

*Twenty-first* Day of *July 1981*

[SEAL]

*Attest:*

GERALD J. MOSSINGHOFF

*Attesting Officer*

*Commissioner of Patents and Trademarks*